US008267744B2

(12) United States Patent
Stratti

(10) Patent No.: US 8,267,744 B2
(45) Date of Patent: Sep. 18, 2012

(54) DRIVE FOR A CUTTING OR GRINDING MACHINE

(75) Inventor: Troy Stratti, Chipping Norton (AU)

(73) Assignee: Troy Stratti, Chipping Norton (AU)

( * ) Notice: Subject to any disclaimer, the term of this patent is extended or adjusted under 35 U.S.C. 154(b) by 0 days.

(21) Appl. No.: 12/825,302

(22) Filed: Jun. 28, 2010

(65) Prior Publication Data

US 2011/0062766 A1 Mar. 17, 2011

Related U.S. Application Data

(63) Continuation of application No. 11/632,864, filed as application No. PCT/AU2005/000826 on Jun. 10, 2005, now abandoned.

(30) Foreign Application Priority Data

Jul. 19, 2004 (AU) ..... 2004903998

(51) Int. Cl.
*B24B 47/00* (2006.01)
*B28D 1/04* (2006.01)

(52) U.S. Cl. ..... 451/11; 125/13.01; 299/39.1

(58) Field of Classification Search ..... 451/11, 451/294, 295; 125/13.01; 299/39.1, 39.3, 299/39.4, 85.1
See application file for complete search history.

(56) References Cited

U.S. PATENT DOCUMENTS 3,290,096 A * 12/1966 Stalker ..... 299/78
4,047,763 A * 9/1977 Gilliland et al. ..... 299/76
4,172,616 A * 10/1979 Delli-Gatti, Jr. ..... 299/80.1
4,542,940 A * 9/1985 Marten ..... 299/1.5
4,785,559 A * 11/1988 Hentschel ..... 37/94
4,838,614 A 6/1989 Pentith et al.
5,561,926 A 10/1996 Stratti
6,135,567 A 10/2000 Cochran
6,626,500 B1 * 9/2003 Cribb et al. ..... 299/78
7,591,089 B2 * 9/2009 Keany ..... 37/408

FOREIGN PATENT DOCUMENTS

AU 762584 7/1999

OTHER PUBLICATIONS

PCT International Search Report dated Oct. 11, 2005 for parent International PCT Patent Application No. PCT/AU2005/000826, filed Jun. 10, 2005; 4 pages.

PCT International Written Opinion dated Oct. 11, 2005 for parent International PCT Patent Application No. PCT/AU2005/000826, filed Jun. 10, 2005; 4 pages.

Office Action dated Jan. 5, 2012, and issued by the Canadian Intellectual Property Office in Canadian Patent Application No. 2,579,772; 4 pages.

* cited by examiner

*Primary Examiner* — Robert Rose
(74) *Attorney, Agent, or Firm* — Ganz Law, P.C.

(57) ABSTRACT

The present invention provides a drive for a grinding or cutting machine. The drive comprises a body having a drive coupling for receiving at least one drive shaft in a manner so that the or each drive shaft is drivable by the drive. The drive also comprises a mount for mounting the body to a portion of the machine such as to a linkage arm of an earth grinding or cutting vehicle. The drive coupling is arranged to inter-fit with a portion of the or each drive shaft.

10 Claims, 6 Drawing Sheets

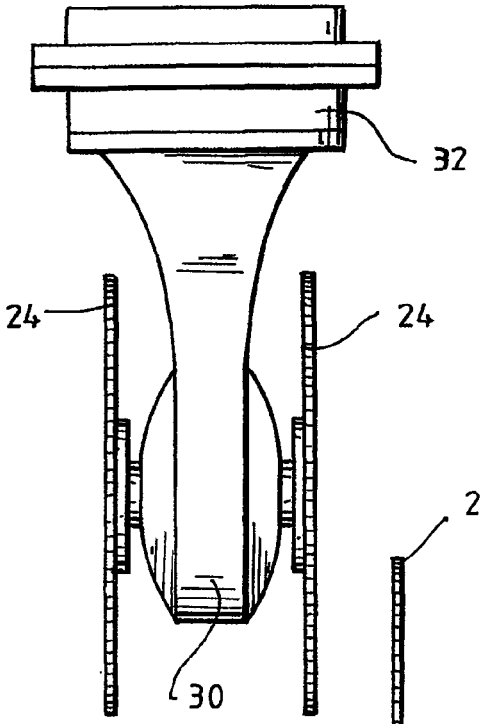
FIG. 7A
FIG. 7B
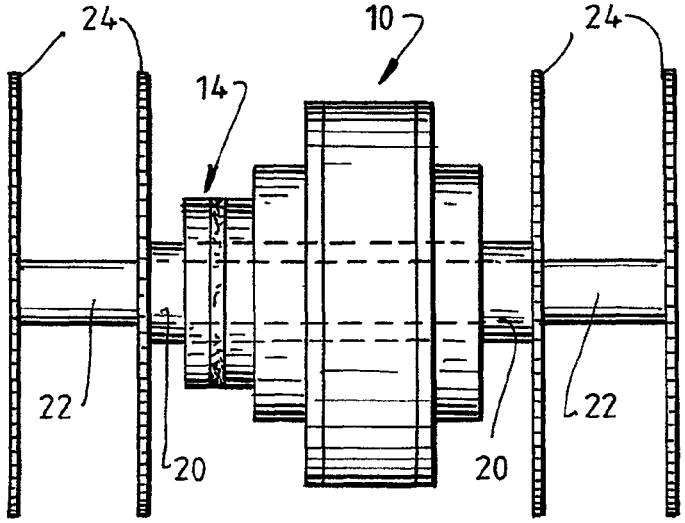

DRIVE FOR A CUTTING OR GRINDING MACHINE

RELATED APPLICATION

This application is a continuation of U.S. application Ser. No. 11/632,864 filed on Jan. 19, 2007 now abandoned which claims priority from PCT/AU05/00826, filed Jun. 10, 2005, each of which claims the benefit of and priority to Australian No 2004903998 filed on Jul. 19, 2004. The disclosures of all applications are hereby incorporated by reference in their entireties for all purposes.

FIELD OF THE INVENTION

The present invention broadly relates to a drive for a grinding or cutting machine. The present invention relates particularly, though not exclusively, to a drive for a grinding or cutting head of a vehicle for grinding or cutting rock or earth formations.

BACKGROUND OF THE INVENTION

Various machines for cutting, grinding and fracturing hard earth formations and rock during excavations (e.g. trimming or planing floor faces, rock side faces, trenching and general building footing detailing) are known in the prior art. Such machines can be removable mounted on the free end of an articulated arm of a tracked or conventionally wheeled excavator and the like.

Conventional grinding or cutting heads typically have a motor which is mounted separately from the tool on the excavator arm, and a gear train is used to transmit torque to the grinding wheels which are rotatably supported at a pedestal or housing bolted to a mounting base member at the linkage arm end remote from the drive. This arrangement considerably limits the grinding head positioning during operation.

Australian patent no. 762584 discloses a grinding head that incorporates the drive. By incorporating the drive into the head, there is no need for an additional gear train between the drive motor and the grinding drums when mounted and the grinding head with drive therefore offers improved flexibility.

The present invention provides an improvement of the invention disclosed in Australian patent no. 762584.

SUMMARY OF THE INVENTION

The present invention provides in a first aspect drive for a grinding or cutting machine comprising:

a body having a drive coupling for receiving at least one drive shaft in a manner so that the or each drive shaft is drivable by the drive and a mount for mounting the body to a portion of the machine, wherein the drive coupling is arranged to inter-fit with a portion of the or each drive shaft.

The coupling typically has a recess for receiving, the portion of the or each drive shaft and typically comprises a clamping mechanism which is arranged to clamp and secure the or each drive shaft.

In one specific embodiment of the present invention the coupling is arranged so that the position, at which the or each drive shaft is securable, is adjustable. In this case a length of a portion of the or each drive shaft that may extend from the body is adjustable. For example, the or each drive shaft may carry a cutting blade or a grinding drum and in this case the drive has the advantage of offering flexibility for positioning of the or each cutting blade or grinding drum relative to the body of the drive.

In one specific embodiment of the present invention the drive has two opposite side portions and may in use carry at least one drive shaft with at least one cutting blade or grinding drum spaced from either side portion. For example the drive may in use carry a pair of cutting blades, one on either side of the drive, and such a "dual blade" drive may be used to form a trench. In this case both cutting blades may cut parallel cuts in rock or hard earth and the earth or rock between the cuts may be removed to form the trench. Using a conventional single blade, it is typically necessary cut a first cut, then move the drive with blade and cut a second cut, and then remove the rock or hard earth between the cuts to form the trench. The "dual blade" arrangement simplifies this procedure significantly. As both cuts are formed simultaneously, it is not necessarily to move the drive with blades to cut the second cut. Further, it is possible to start removing the hard earth or rock between the cuts to start forming the trench immediately after only a portion of the length of the cuts has been formed which also has a significant practical advantage. In addition, if the relative position of the blades is adjustable, the width of the trench is adjustable which is a further practical advantage. Alternatively, such a drive may be arranged to cut rock or stone such as sandstone in an economic manner as more than one cut may be cut simultaneously.

The mount typically is arranged for mounting the drive to a linkage arm such as a linkage arm of an earth or rock cutting or grinding vehicle.

Typically, the recess is an elongated hollow portion which has two openings. The hollow portion may extend through the body and may be a straight portion. Alternatively, the coupling may comprise two hollow portions each being arranged for receiving one drive shaft and which may be aligned. In either case, at least two drive shafts, which may carry blades or drums for cutting or grinding, may be fitted to the drive. For example, the drive shafts may be fitted from either side of the drive so that a dual cutting blade or grinding drum drive head is formed. The drive shafts may also comprise a plurality of cutting blades or grinding drums so that a cutting or grinding head can be formed having more than two cutting blades or grinding drums. If the recess extends through the body, one drive shaft may be received by the recess in a manner such that the drive shaft can carry one or more cutting blades or grinding drums at either ends of the drive shaft.

The drive may comprise the or each drive shaft and in one specific embodiment of the present invention the drive comprises a first drive shaft that has a hollow shaft portion extending along an axis of the first drive shaft. In this embodiment, the hollow shaft portion is arranged to receive at least one second drive shaft for securing in the first drive shaft. The first shaft and the or each second drive shaft may each be arranged to carry at least one blade or drum, for example at an end-portion.

The first drive shaft may in use be positioned in the or each hollow portion of the drive coupling and the or each second drive shaft may in use be positioned in the hollow shaft portion of the first drive shaft. For example, the hollow shaft portion of the first drive shaft may have two ends and two second drive shafts may be receivable by the first drive shaft, one from either end.

In one embodiment one second drive shaft extends in use from a side of the body. Alternatively or additionally, a further second drive shaft may in use extend form an opposite side of the body.

For example, one drive shaft carrying at least one blade or drum may be in use be secured in the drive coupling which may be arranged to adjust the position of the or each blade or drum relative to the drive. Alternatively, two drive shafts may in use be secured in the drive coupling, either from the same side or from opposite sides, and the drive coupling may be arranged to adjust the position of at least two of the blades or drums relative to each other.

The second drive shaft may also have a hollow portion arranged to receive at least one further drive shaft that may carry a further cutting blade or grinding drum.

In one specific embodiment the coupling comprises a shrink disk fitted to the body and having an aperture that is shrinkable so that a drive shaft may be secured in the aperture. The shrink disk has the particular advantage that is relatively easy to exchange and/or adjust the or each drive shaft.

The shrink disk typically is arranged so that at least one second drive shaft is in use clamped in the first drive shaft and the shrink disk secures the first drive shaft in the coupling. Alternatively, the or each second drive shaft may be secured in the first drive shaft by means of bolts, splints or keyways.

The coupling may also comprise a another means for securing a shaft at a fixed position. For example, the coupling may comprise the shrink disk for securing a drive shaft in a manner so that the drive shaft is adjustable and may also comprise the other means for securing a further drive shaft at a fixed position. Typically, the shrink disk and the means for securing are positioned at opposite ends of the hollow portion of the drive coupling. For example, the other means may comprise flanges and bolts or the like to hold the or each drive shaft in position.

Alternatively, drive my not comprise a shrink disk and the position of the or each drive shaft relative to the drive may not be adjustable. In this case the or each drive shaft may be coupled to the drive for example only by flanges and bolts or the like. For example one drive shaft may in use be positioned in the recess of the drive and arranged so that flanges on either side of the drive hold the drive shaft in that position. The flanges typically are arranged to carry cutting blades or grinding drums.

The drive may comprise an electric motor. Alternatively, the drive may comprise a hydraulic drive means.

In one specific embodiment the drive comprises two cutting blades or grinding drums, on at either side of the body.

In one specific embodiment of the present invention the body is a first body and has a first side portion and an opposite second side portion. In this embodiment the or each drive shaft is arranged to carry at least one cutting blade or grinding drum spaced from the first side portion and a second body is attachable at the second side portion. The or each drive shaft typically is arranged so that, if the second body is not attached, at least one cutting blade or grinding, drum can be carried spaced from the second side portion. The second body typically comprises a second mount which typically is arranged for mounting to a linkage arm such as a linkage arm of an earth or rock cutting or grinding vehicle.

If the second body is attached to the first body, a user can choose which one of the mounts he prefers to use for mounting the drive to a portion of the machine such as a to the linkage arm. For example, by choosing which mount is used for mounting the user may be able to choose a grinding or cutting position of the or each cutting blade or grinding drum relative to the machine which offers additional flexibility.

The present invention provides in a second aspect: a grinding or cutting machine comprising the drive according to the first aspect of the invention.

In one specific embodiment of second aspect of the present invention the drive is mounted on the linkage arm extending from a body of the machine in a manner so that in use the or each drive shaft extends in a transversal direction relative to direction in which the arm extends from the body of the machine.

In the first and the second aspects of the present invention the machine typically is a vehicle.

The present invention provides in a third aspect a method of cutting or grinding rock or hard earth using the drive as claimed any one of the preceding claims.

The present invention provides in a fourth aspect a method of forming a trench in hard rock or earth, the trench having a length and the method comprising:

simultaneously cutting at least two cuts into the hard earth or rock and, after at least portions of the cuts have been completed removing the hard rock or earth between the completed portions of the cuts.

The at least two cuts typically are parallel to each other. At least a portion of the hard earth and rock typically is removed between the completed portions of the cuts while cutting of the cuts continues.

The invention will be more fully understood from the following description of specific embodiments of the invention. The description is provided with reference to the accompanying drawings.

DETAILED DESCRIPTION OF SPECIFIC EMBODIMENTS

Figure 1:
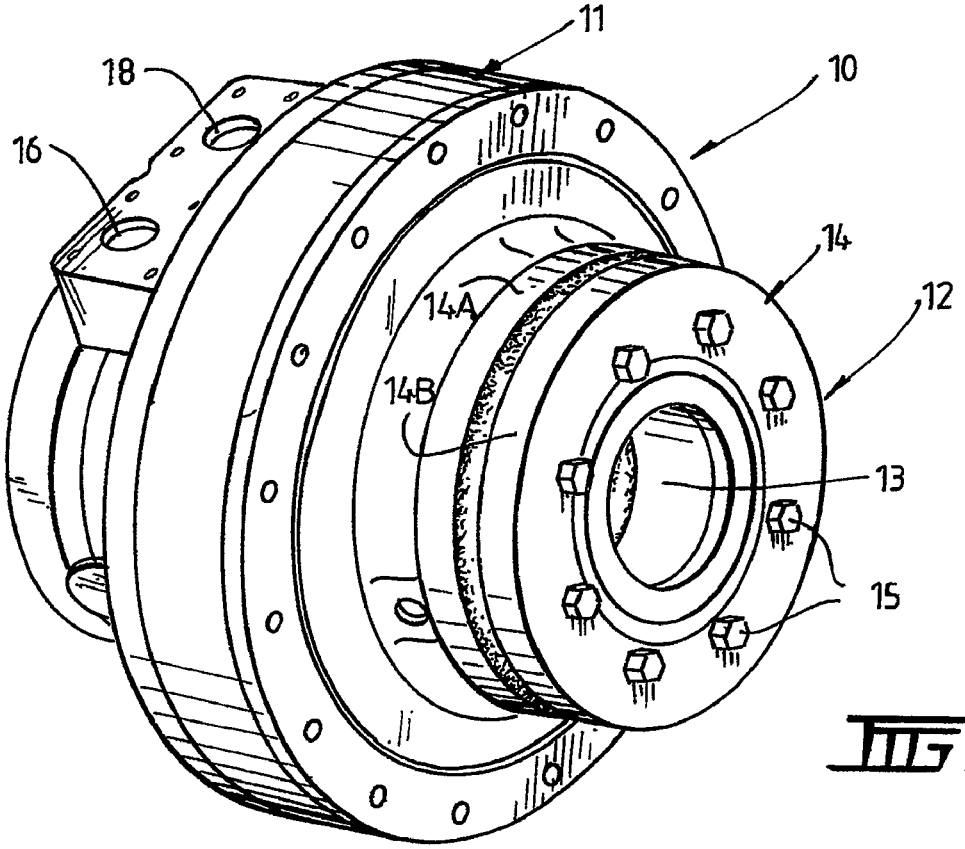
FIG. 1 shows a schematic perspective view of a drive according to a specific embodiment of the present invention.

Referring initially to FIG. 1 a drive for a grinding or cutting machine according to a specific embodiment as now described. FIG. 1 shows the drive 10 having a body (a portion of the body 11 is shown in FIG. 1) and a coupling 12. In this embodiment, the coupling 12 comprises a recess 13 that extends through the entire drive 10. The drive coupling 12 is arranged to receive a draft shaft (not shown) in the recess 13. The drive further comprises a shrink disk 14 which is arranged to secure the drive shaft in the coupling 12. The shrink disk has an aperture which reduces its diameter when bolts 15 are tightened. The shrink disk 14 comprises a rubber-like material that is clamped between disks 14A and 14B when bolts 15 are tightened so that the rubber-like material extends towards an axis of the recess 13 so that a drive shaft, when positioned in the recess 13, is clamped.

It is to be appreciated that in a variation of this embodiment the drive 10 may not comprise a shrink disk but other means may be used to secure a shaft such as nuts and bolts and/or flanges.

In this embodiment the drive shaft may be clamped at a variety of positions along the length of the drive shaft so that the drive shaft is adjustable relative to the drive 10. For example, the drive shaft may carry a grinding drum or cutting blade. The drive 10 also comprises a mount (not shown) for mounting the drive 10 to a linkage arm of an earth or rock cutting or grinding machine such as a vehicle. Further, the body 11 has an outer housing portion (which is not shown in FIG. 1 in order to facilitate illustration of other components).

It is to be appreciated that in a further variation of this embodiment the position of the drive shaft may not be adjustable relative to the drive.

In this embodiment the drive 10 comprises a hydraulic motor and has an opening 16 to receive the hydraulic fluid and an opening 18 that functions as an outlet for the hydraulic fluid. It will be appreciated, however, that in a variation of this embodiment the drive 10 may also comprise an electric motor.

Figure 2:
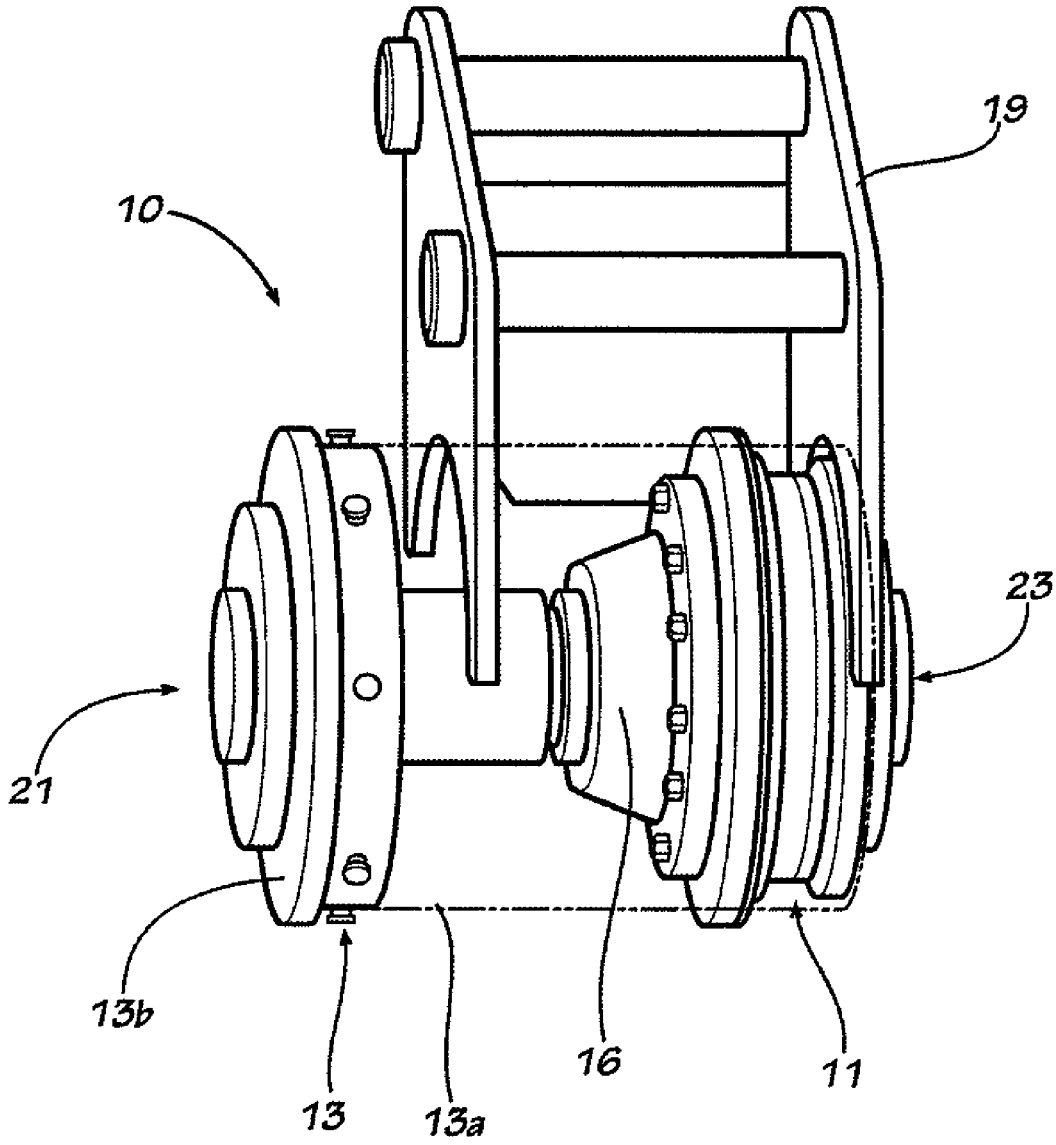
FIG. 2 shows a schematic perspective view of a drive according to another specific embodiment of the present invention.

FIG. 2 shows the drive 10 with mount 19 for mounting the drive to a linkage arm of an earth or rock cutting or grinding machine such as a vehicle. FIG. 2 also shows mounting flanges 21 and 23 for receiving cutting blades or grinding drums (not shown). In FIG. 2 the outer housing portion 13 of the body 11 is also indicated. The housing portion 13 is in this embodiment cylindrical having wall portions 13*a* and 13*b* (a wall portion that opposes portion 13 *b* is formed by the body 11).

Figure 3:
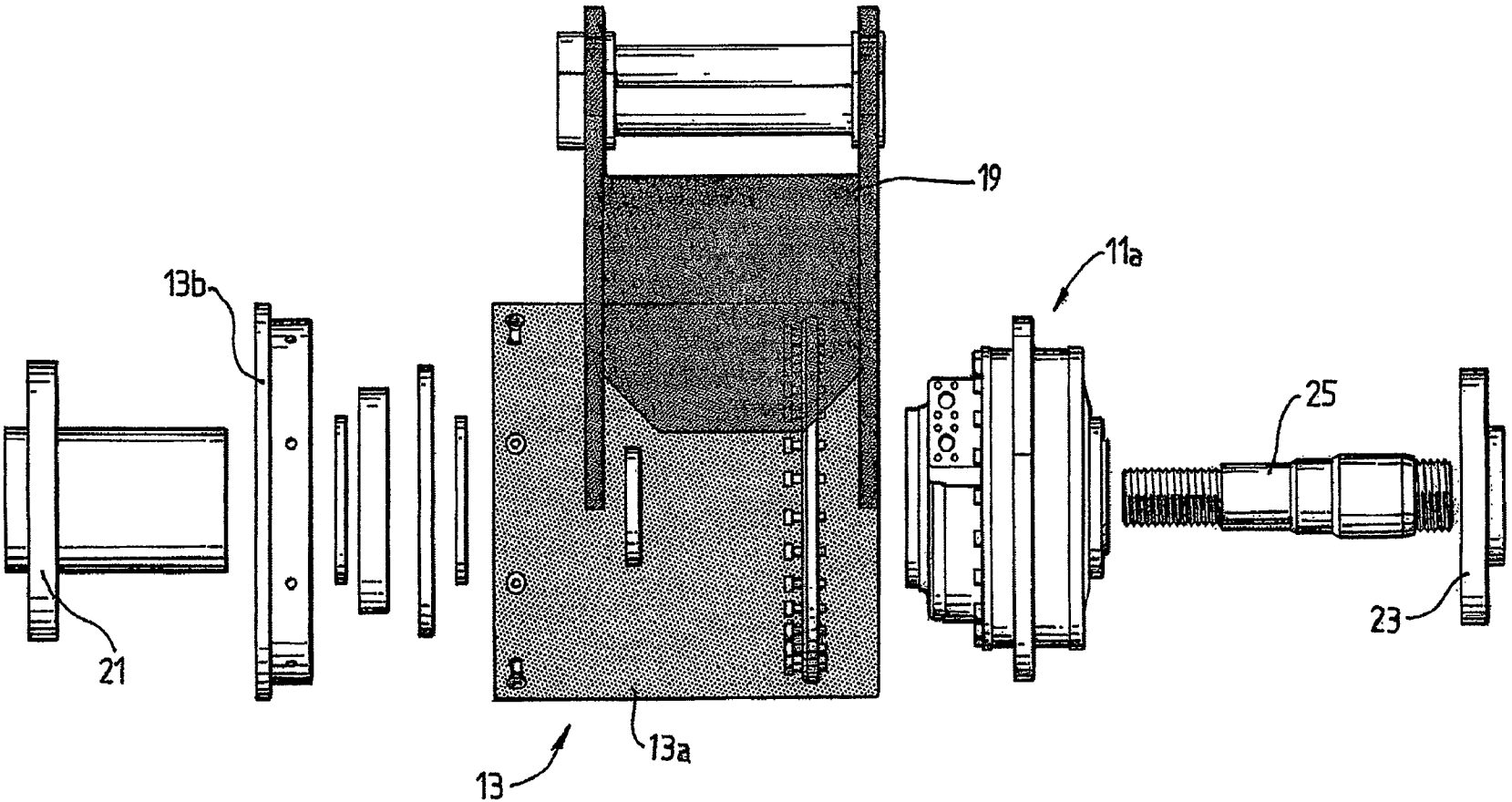
FIG. 3 shows a side view of a drive according to a further embodiment of the present invention, FIGS. 4 (*a*) and (*b*) show cross-sectional representations of drive shafts according to a further specific embodiment of the present invention.

FIG. 3 shows a drive according to a further embodiment of the present invention. In this embodiment the drive comprises a body 11*a* which does not comprise a shrink disk. Shaft 25 has two threaded ends for receiving the flanges 21 and 23 and the shaft 25 is held in the body 11*a* by the flanges 21 and 23. The flanges 21 and 23 are arranged to receive cutting blades or grinding drums.

Figure 4A:
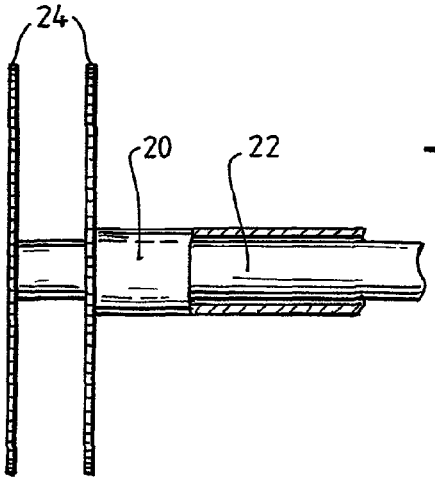

FIG. 4 shows drive shafts according to other embodiments of the present invention. FIG. 4 A shows a drive shaft 20 that carries a cutting blade 24. In this embodiment, the drive shaft 20 is hollow and is arranged to receive a further drive shaft 22 carrying a further blade 24. The drive shaft 20 is arranged to be received in the recess 13 of the coupling 12. The drive shaft 22 is securable in the drive shaft 20. In this embodiment, the drive shafts 22 and 20 are adjustable relative to each other so that the positions of the blades 24 can be adjusted relative to each other. In this embodiment the shafts are arranged so that the two blades 24 are positioned on the same side of the drive 10 shown in FIG. 1 or 2.

Figure 4B:
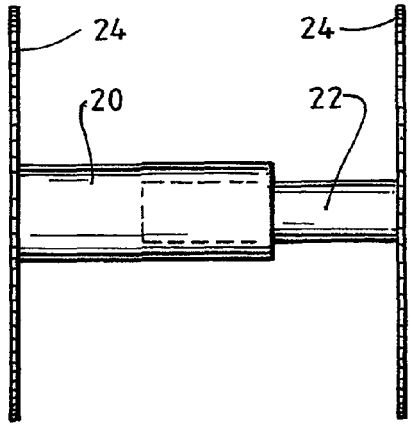

FIG. 4B shows a further arrangement of the drive shafts. In this embodiment drive shaft 20 receives drive shaft 22 so that the blades 22 are positioned at opposing ends of the arrangement. Using the shaft and blade arrangements shown in FIGS. 4A and 4B, dual cutting heads can be formed with drive 10. In embodiment shown in FIG. 4A, the two blades would be positioned on one side of the drive 10. The position of the two blades relative to the drive can be adjusted by adjusting the position of the outer shaft 20 relative to the drive coupling 12. Using the arrangement shown in FIG. 4B a dual cutting head can be formed having one blade on either side of the drive 10. Again, the relative position of the two blades relative to the drive 10 can be adjusted by adjusting the position of the outer shaft 20 in the coupling 12.

Figure 5:
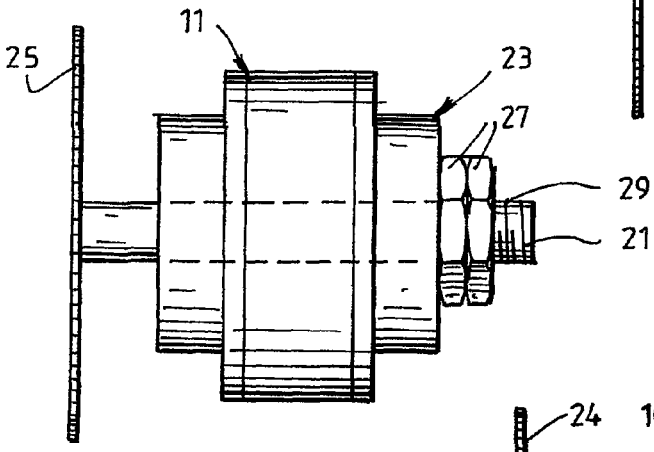
FIG. 5 shows a drive according to another specific embodiment of the present invention.

FIG. 5 shows a drive according to another embodiment of the invention. The coupling 23 of the drive has a drive shaft 21 fitted to it which carries a cutting blade 25. In this embodiment the drive shaft 21 comprises a thread 29 and is secured by a pair of nuts 27.

Figure 6:
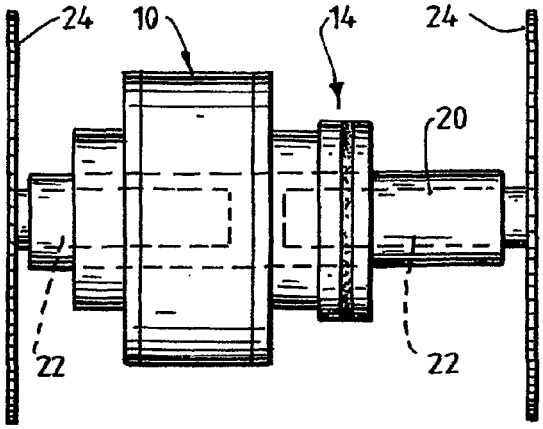
FIG. 6 shows a cross-sectional representations of drive shafts according to yet another specific embodiment of the present invention, FIGS. 7 (*a*) and (*b*) show drives according to further specific embodiments of the present invention.

FIG. 6 shows a further embodiment of the invention. In this case hollow outer shaft 20 has received two inner shafts 22 from either end. Each inner shaft 22 carries a cutting blade 24. The inner shafts 22 are secured in the outer shaft 20 and the positions of the blades relative to the drive 10 are adjustable by adjusting outer shaft 20 in shrink disk 14.

It is to be appreciated that in a variation of this embodiment the shafts 22 may be directly inserted into the drive 10 without the hollow shaft 20. In this case the positions of the shafts relative to each other and relative to the drive body may or may not be adjustable.

In the embodiments shown in FIGS. 1 and 6, the shrink disks 14 are arranged so as to clamp the outer drive shafts 20 which in turn clamp respective inner drive shafts 22. Alternatively, the inner shafts 22 may also be secured in a respective outer drive shafts 20 by means of bolts, splints or keyways.

FIG. 7 A shows drive 30 which is analogous to drive 10 but in this case comprises a frame that is linked to a linkage arm of a cutting or grinding vehicle. In this embodiment, the drive 30 with blades 24 is relatively narrow having a width that approximates that of a mount 32.

FIG. 7 B shows another embodiment of the invention. The embodiment shown in FIG. 7 B is related to that shown in FIG. 4 A. However, in this case the shaft 20 comprises two blades 24 and is secured by coupling 14 of drive 10. Further, the machine comprises two shafts 22 which are secured in hollow shaft 20 and which each comprise a blade 24. The relative position of the four blades relative to the drive 10 is adjustable by adjusting the position of the shaft in coupling 14. This arrangement therefore forms an adjustable quad blade cutting head.

It will be appreciated, however, that the invention is not limited to a particular number of shafts or cutting blades. Following the principle of the embodiment shown in FIG. 7, a number of shafts may be inter-fitted and the head may comprise a number of cutting blades. Further, each shaft may carry more than one cutting blade. In addition, the present invention is not limited to cutting blades. For example, alternatively the shafts may carry grinding drums.

Figure 8:
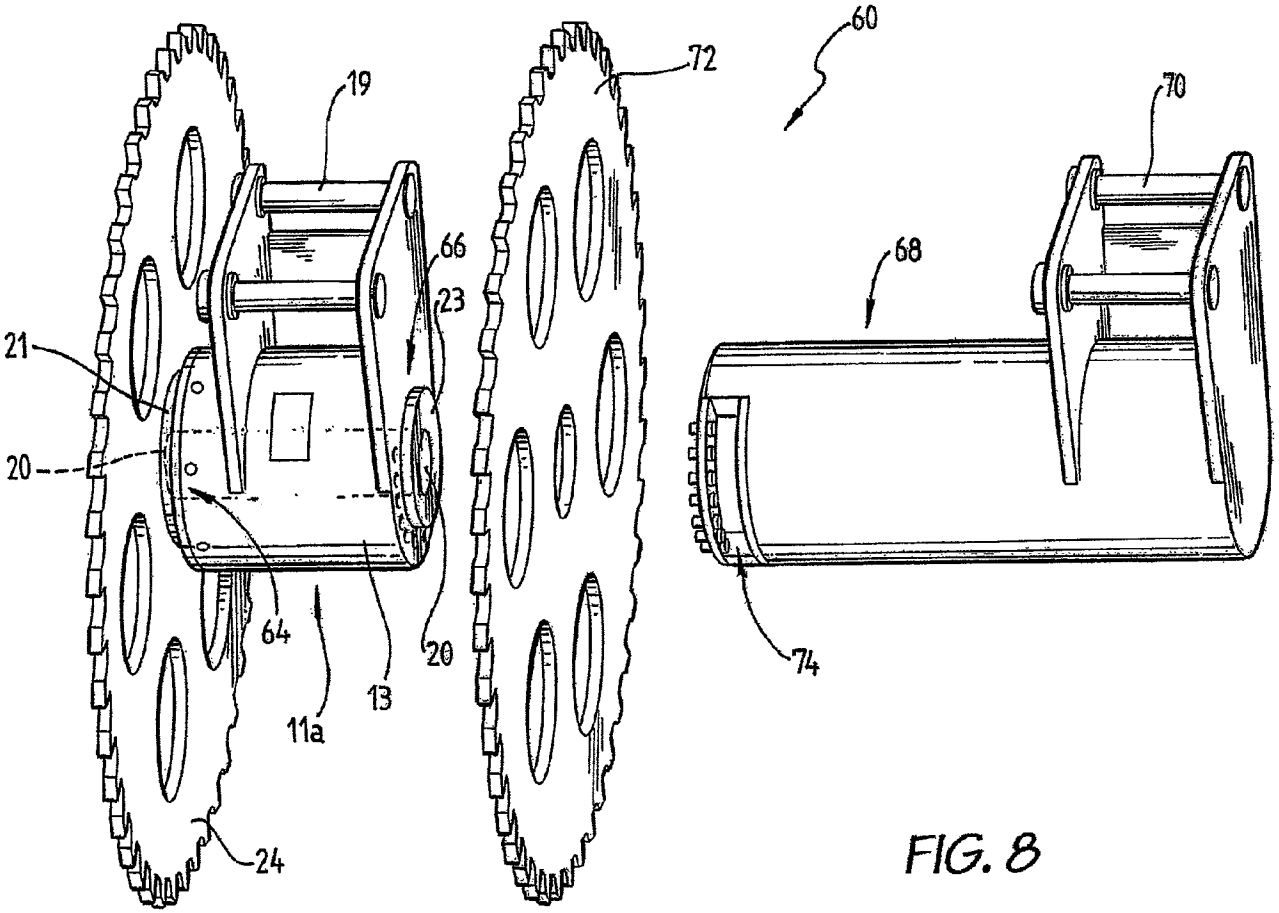
FIG. 8 shows a drive according to another specific embodiment of the present invention.

FIG. 8 shows a drives according to a further specific embodiment of the present invention. In this embodiment the drive 60 comprises a drive shaft 20 with cutting blade 24. The body 11*a* with housing 13 of the drive 60 has a mount 19 for mounting to a linkage arm of a vehicle (not shown). In this embodiment the housing 13 of the body 11*a* has two opposing side portions 64 and 66. The blade 24 is attached to the drive shaft 20 at the first side portion 64 via flange 21. The drive 60 is in this embodiment arranged so that a second body 68 can be attached to the second side portion 66. The second body 68 also comprises a mount 70 for attachment to the linkage arm of the vehicle.

The drive 60 is arranged so that, if the second body 68 is not attached to the side portion 66, a cutting blade 72 (or grinding drum) is attachable to the drive shaft 20 at the second side portion 66 and via flange 23.

If the second body 68 is attached to the first body 11, a user can choose which one of the mounts 19 and 70 he prefers to use for mounting the drive 60 to the linkage arm of the vehicle. For example, if mount 70 is used form mounting, the blade 24 is offset to one side of the vehicle. Alternatively, if the mount 19 is used for mounting the drive 60, the drive 60 may be positioned at a more central location. The drive 60 therefore offers additional flexibility.

The second body 68 has a recess 74 and a side portion 76 which forms a recessed flange. The side portion 74 has apertures for bolts via which the second body 68 is coupled to the first body 11*a*. The flange is recessed and therefore the drive 60 has the advantage that no outer flange limits a cutting or grinding depth of the drive 60.

It is to be appreciated that in variations of the embodiment shown in FIG. 8 at least one grinding drum may be attachable to the drive shaft 20 at either side portion of the body 11. Further, the drive 60 may be arranged for attachment of any number of cutting blades or grinding drums at either side portion.

Although the invention has been described with reference to particular examples, it will be appreciated by those skilled in the art that the invention may be embodied in many other forms. Further, the drive may not comprise a recess but may alternatively comprise a projection over which a hollow portion of a drive shaft may be fitted. In addition the drive may be one of two or more drives forming a multi-drive cutting or grinding head.

Further, the reference that is being made to Australian patent no. 762584 does not constitute an admission that this patent is a part of the common general knowledge in Australia or in any other country.

The invention claimed is:

1. A drive unit for a grinding or cutting machine on a vehicle, the drive unit comprising:

at least one drive shaft;

a drive comprising an electric or hydraulic motor and having a recess for receiving at least a portion of the at least one drive shaft and having a drive coupling arranged to inter-fit with a portion of the at least one drive shaft for transmitting drive to the at least one drive shaft;

a mount for mounting the drive unit to a linkage arm of the cutting machine; and at least two substantially circular cutting blades;

wherein each cutting blade is mounted to the drive shaft or a respective drive shaft in a manner such that the cutting blades are spaced apart from one another and are drivable by the drive;

wherein an envelope defined by the projection of a periphery of the cutting blades in a direction parallel an axis of the drive shaft, on which the at least one of the cutting blades is mounted, contains the drive; and wherein the recess is an elongated hollow portion which has two openings and wherein the hollow portion extends through the drive.

2. A drive unit for a grinding or cutting machine on a vehicle, the drive unit comprising:

at least one drive shaft;

a drive comprising an electric or hydraulic motor and having a recess for receiving at least a portion of the at least one drive shaft and having a drive coupling arranged to inter-fit with a portion of the at least one drive shaft for transmitting drive to the at least one drive shaft;

a mount for mounting the drive unit to a linkage arm of the cutting machine; and at least two substantially circular cutting blades;

wherein each cutting blade is mounted to the drive shaft or a respective drive shaft in a manner such that the cutting blades are spaced apart from one another and are drivable by the drive;

wherein an envelope defined by the projection of a periphery of the cutting blades in a direction parallel an axis of the drive shaft, on which the at least one of the cutting blades is mounted, contains the drive; and wherein the drive comprises a first drive shaft and at least one second drive shaft, the first drive shaft having a hollow shaft portion extending along an axis of the first drive shaft, the hollow portion being arranged to receive each second drive shaft for securing in the first drive shaft.

3. The drive unit of claim 2 wherein, the first drive shaft is positionable in the hollow portion of the drive coupling and the at least one second drive shaft is positionable in the hollow shaft portion of the first drive shaft.

4. The drive unit as claimed in claim 1, wherein the drive unit is arranged so that the envelope defined by the projection of a periphery of at least one of the cutting blades in a direction parallel the axis of the drive shaft, on which the at least one of the cutting blades is mounted, contains the drive shaft and the mount.

5. The drive unit as claimed in claim 4, wherein the at least two substantially circular cutting blades comprises two parallel cutting blades and wherein the drive is positioned between the two cutting blades.

6. The drive unit of claim 1 wherein the coupling is arranged so that the position, at which one or more of the at least one drive shaft is securable, is adjustable.

7. The drive unit of claim 1 wherein the drive comprises a first drive shaft and at least one second drive shaft, the first drive shaft having a hollow shaft portion extending along an axis of the first drive shaft, the hollow portion being arranged to receive each second drive shaft for securing in the first drive shaft.

8. The drive unit of claim 7 wherein, the first drive shaft is positionable in the hollow portion of the drive coupling and the at least one second drive shaft is positionable in the hollow shaft portion of the first drive shaft.

9. The drive unit of claim 1 wherein the at least one drive shaft is positionable in the recess of the drive unit and wherein the drive unit comprises flanges that are positioned to secure the shaft in a rotatable position.

10. The drive unit of claim 1 wherein the drive is mounted on the linkage arm in a manner so that in use each drive shaft extends in a transversal direction relative to a direction in which the arm extends from a body of the vehicle.

* * * * *